US011214882B2

(12) United States Patent
Kaczmarek et al.

(10) Patent No.: US 11,214,882 B2
(45) Date of Patent: Jan. 4, 2022

(54) ACIDIC ZINC OR ZINC-NICKEL ALLOY ELECTROPLATING BATH FOR DEPOSITING A ZINC OR ZINC-NICKEL ALLOY LAYER

(71) Applicant: Atotech Deutschland GmbH, Berlin (DE)

(72) Inventors: Michal Kaczmarek, Berlin (DE); Zdenek Starkbaum, Berlin (DE); Sebastian Hahn, Berlin (DE); Ercan Karapinar, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 15/734,257

(22) PCT Filed: Jun. 3, 2019

(86) PCT No.: PCT/EP2019/064329
§ 371 (c)(1),
(2) Date: Dec. 2, 2020

(87) PCT Pub. No.: WO2019/238454
PCT Pub. Date: Dec. 19, 2019

(65) Prior Publication Data

US 2021/0246565 A1 Aug. 12, 2021

(30) Foreign Application Priority Data

Jun. 11, 2018 (EP) ..... 18177041

(51) Int. Cl.
*C25D 3/22* (2006.01)
*C25D 3/56* (2006.01)

(52) U.S. Cl.
CPC ..... *C25D 3/22* (2013.01); *C25D 3/565* (2013.01)

(58) Field of Classification Search
CPC ..... C25D 3/22; C25D 3/562; C25D 3/565; C25D 5/00
USPC ..... 205/259, 260, 312, 313, 314, 143, 145, 205/244, 246
See application file for complete search history.

(56) References Cited

U.S. PATENT DOCUMENTS 6,153,079 A * 11/2000 Klam ..... C25D 3/22 205/138
7,442,286 B2 10/2008 Capper et al.
8,329,018 B2 12/2012 Reddington et al.
8,335,398 B2 12/2012 Omori
9,322,107 B2 4/2016 Brunner et al.
10,858,747 B2 12/2020 Kaczmarek et al.
2005/0126427 A1 6/2005 Gonzalez et al.
2005/0133376 A1* 6/2005 Opaskar ..... C25D 3/565 205/246
2005/0209117 A1 9/2005 Friedrich et al.
2006/0201820 A1 9/2006 Opaskar et al.
2008/0087549 A1 4/2008 Ishizuka et al.
2010/0155257 A1 6/2010 Brunner et al.
2010/0236936 A1 9/2010 Brunner et al.
2012/0018310 A1 1/2012 Roeger-Goepfert et al.
2012/0160698 A1* 6/2012 Brunner ..... C08G 71/02 205/244

FOREIGN PATENT DOCUMENTS

DE 3839824 A1 * 6/1989 ..... C25D 3/22
DE 3839824 A1 6/1989
JP 2007308761 A 11/2007
KR 1020070048211 A 5/2007
RU 2093613 C1 10/1997
SU 876798 A1 10/1981
TW 200722558 A 6/2007

OTHER PUBLICATIONS

Horvick, "Zinc in the World of Electroplating," Plating and Surface Finishing (Jun. 2006), vol. 93, No. 6, pp. 42-48. (Year: 2006).*
PCT/EP2019/064329; PCT International Search Report and Written Opinion of the International Searching Authority dated Aug. 21, 2019.
T. Akiyama et al.; "Role of polyethylene glycol in electrodeposition of zinc-chromium alloys"; Journal of Applied Electrochemistry 30: pp. 817-822, 2000.
H.H. Hassan et al.; "Inhibition of mild steel corrosion in hydrochloric acid solution by triazole derivatives Part I. Polarization and EIS studies"; Electrochimica Acta 52 (2007) pp. 6359-6366.
Search Report for Indian Application No. 202027053984 dated Apr. 12, 2021.
Search Report for Korean Application No. 10-2020-7036069 dated Mar. 1, 2021.
Office Action for corresponding Chinese Application No. 201980039314.3 dated May 13, 2021.
Office Action for corresponding Japanese Application No. 2020-568777 dated May 31, 2021.
Office Action for corresponding Russian Application No. 2020142973 dated May 18, 2021.

* cited by examiner

*Primary Examiner* — Edna Wong
(74) *Attorney, Agent, or Firm* — Renner, Otto, Boisselle & Sklar, LLP

(57) ABSTRACT

The present invention is related to an acidic zinc or zinc-nickel alloy electroplating bath for depositing a zinc or zinc-nickel alloy layer and a method for zinc or zinc-nickel alloy electroplating making use of such an electroplating bath.

21 Claims, No Drawings

ACIDIC ZINC OR ZINC-NICKEL ALLOY ELECTROPLATING BATH FOR DEPOSITING A ZINC OR ZINC-NICKEL ALLOY LAYER

The present application is a U.S. National Stage Application based on and claiming benefit and priority under 35 U.S.C. § 371 of International Application No. PCT/EP2019/064329, filed 3 Jun. 2019, which in turn claims benefit of and priority to European Application No. 18177041.3 filed 11 Jun. 2018, the entirety of both of which is hereby incorporated herein by reference.

FIELD OF THE INVENTION

The present invention relates to an acidic zinc or zinc-nickel alloy electroplating bath for depositing a zinc or zinc-nickel alloy layer. The invention is further directed to a method for zinc or zinc-nickel alloy electroplating making use of such an electroplating bath.

BACKGROUND OF THE INVENTION

Zinc and zinc alloy electroplating are standard methods to increase resistance to corrosion of metallic substrates such as cast iron and steel substrates. The most common zinc alloys are zinc-nickel alloys. The electroplating baths used for said purpose are generally divided in acidic and alkaline (cyanide and non-cyanide) electroplating baths.

Electroplating methods using acidic zinc and zinc-nickel alloy electroplating baths show several advantages over alkaline electroplating baths such as a higher current efficiency, higher brightness of the deposit, electroplating speed and less hydrogen embrittlement of the electroplated substrate (Modern Electroplating, M. Schlesinger, M. Paunovic, $4^{th}$ Edition, John Wiley & Sons, 2000, page 431).

A disadvantage of zinc and zinc-nickel alloy electroplating methods using acidic electroplating baths over alkaline electroplating baths is the decreased throwing power. Accordingly, the thickness of the zinc or zinc-nickel alloy deposit shows a higher dependency of the local current density. The thickness of the deposit (and likewise the resistance to corrosion) is lower in substrate regions where the local current density is lower and higher in substrate regions where the local current density is higher. The inferior throwing power of acidic zinc and zinc-nickel alloy electroplating methods is particularly a concern when electroplating substrates having a complex shape such as brake calipers and/or when using rack-and-barrel electroplating.

OBJECTIVE OF THE PRESENT INVENTION

In view of the prior art, it was thus an object of the present invention to provide an acidic zinc or zinc-nickel alloy electroplating bath for depositing a zinc or zinc-nickel alloy layer, which shall exhibit an improved electroplating behavior at low local current densities and accordingly, an improved thickness uniformity of the deposit, particularly when electroplating substrates having a complex shape and/or in rack-and-barrel electroplating applications.

Furthermore, it was an object of the present invention to provide an acidic zinc or zinc-nickel alloy electroplating bath, which shall be able to reduce or ideally avoid burnings in the high current density areas while the thickness in the low current density areas is simultaneously improved.

SUMMARY OF THE INVENTION

These objects and also further objects which are not stated explicitly but are immediately derivable or discernible from the connections discussed herein by way of introduction are achieved by an acidic zinc or zinc-nickel alloy electroplating bath having all features as described herein. Appropriate modifications of the inventive electroplating bath are possible as will be understood. Further, the present invention further comprises a method for zinc or zinc-nickel alloy electroplating making use of such an electroplating bath.

The present invention accordingly provides an acidic zinc or zinc-nickel alloy electroplating bath for depositing a zinc or zinc-nickel alloy layer characterized in that the electroplating bath comprises (i) at least a zinc ion source (ii) at least one triazole derivative having the general formula (I)

(I)

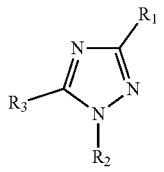

wherein $R_1$ is selected from the group consisting of hydrogen, thiol, carboxylic acid, amino, methyl, methylsulfonyl, and methyl carboxylate;

$R_2$ is hydrogen or phenyl; and $R_3$ is selected from the group consisting of hydrogen, amino, thiol, and phenyl;

(iii) at least one first poly(ethylene glycol) derivative having the general formula (II)

$$R_4\text{-}\mathbf{13}\ [O—CH_2—CH_2]_n—O—R_5 \quad \text{(II)}$$

wherein n is ranging from 2 to 200;

$R_4$ is selected from the group consisting of a linear or branched $C_1$-$C_{18}$ alkyl, 4-nonylphenyl, and a linear or branched $C_1$-$C_{18}$ alkyl having a carboxylic group;

$R_5$ is selected from the group consisting of $—CH_2—CH_2—CH_2—SO_3Z$, $—CH_2—CH_2—SH$, and tosyl;

wherein Z is a monovalent cation such as a potassium, sodium or ammonium ion; and (iv) in case of a zinc-nickel alloy electroplating bath at least a nickel ion source.

It is thus possible in an unforeseeable manner to provide an acidic zinc or zinc-nickel alloy electroplating bath for depositing a zinc or zinc-nickel alloy layer, which exhibits an improved electroplating behavior at low local current densities and accordingly, improved thickness uniformity of the deposit, particularly when electroplating substrates having a complex shape and/or in rack-and-barrel electroplating applications. Furthermore, the present invention offers an acidic zinc or zinc-nickel alloy electroplating bath, which is able to avoid burnings in the high current density areas while the thickness in the low current density areas is simultaneously improved.

BRIEF DESCRIPTION OF THE TABLES

Objects, features, and advantages of the present invention will also become apparent upon reading the following description in conjunction with the tables, in which:

Table 1 exhibits conducted experiments (at 1 Ampère) for acidic zinc electroplating baths in accordance with embodiments of the present invention and in accordance with comparative embodiments outside of the present invention.

Table 2 exhibits conducted experiments (at 1 Ampère) for acidic zinc-nickel alloy electroplating baths in accordance with embodiments of the present invention and in accordance with comparative embodiments outside of the present invention.

DETAILED DESCRIPTION OF THE INVENTION

Said acidic zinc or zinc-nickel alloy electroplating bath according to the present invention is preferably an aqueous bath. The water content of such an aqueous bath is more than 80% by volume, preferably more than 90% by volume, and more preferably more than 95% by volume of all solvents used. The pH value of such an acidic zinc or zinc-nickel alloy electroplating bath is ranging from 2 to 6.5, preferably from 3 to 6, and more preferably from 4 to 6.

Suitable sources for zinc ions comprise ZnO, $Zn(OH)_2$, $ZnCl_2$, $ZnSO_4$, $ZnCO_3$, $Zn(SO_3NH_2)_2$, zinc acetate, zinc methane sulfonate and mixtures of the aforementioned.

Suitable sources for optional nickel ions, which are only comprised if a zinc-nickel alloy electroplating bath is desired, comprise $NiCl_2$, $NiSO_4$, $NiSO_4.6H_2O$, $NiCO_3$, $Ni(SO_3NH_2)_2$, nickel acetate, nickel methane sulfonate and mixtures of the aforementioned.

The acidic zinc or zinc-nickel alloy electroplating bath according to the present invention then further comprises a complexing agent for nickel ions. Said complexing agent is preferably selected from aliphatic amines, poly-(alkyleneimines), non-aromatic poly-carboxylic acids, non-aromatic hydroxyl carboxylic acids and mixtures of the aforementioned.

The source of nickel ions and the complexing agent is preferably added to the electroplating bath as such.

In one embodiment of the present invention, the source for nickel ions is mixed with the complexing agent for nickel ions in water prior to addition to the electroplating bath. Accordingly, a nickel complex compound/salt, derived from the mixture of the complexing agent for nickel ions and nickel ions, is added as the source of nickel ions to the electroplating bath.

Suitable aliphatic amines comprise 1,2-alkylenimines, monoethanolamine, diethanolamine, triethanolamine, ethylendiamine, diethylentriamine, triethylenetetramine, tetraethylenepentamine, pentaethylenehexamine and the like.

Suitable poly-(alkyleneimines) are for example Lugalvan® G-15, Lugalvan® G-20 and Lugalvan° G-35, all available from BASF SE.

Suitable non-aromatic poly-carboxylic acids and non-aromatic hydroxyl carboxylic acids preferably comprise compounds capable to form chelate complexes with zinc ions and/or nickel ions such as citric acid, tartaric acid, gluconic acid, alpha-hydroxybutyric acid etc. and salts thereof like the corresponding sodium, potassium and/or ammonium salts.

The concentration of the at least one complexing agent for nickel ions preferably ranges from 0.1 to 150 g/l, more preferably from 1 to 50 g/l.

The expression "electroplating bath" in the context of the present invention means that such an inventive acidic zinc or zinc-nickel alloy bath is always applied with current. Electroless zinc or zinc-nickel alloy baths would have a different chemical bath composition. Thus, electroless baths are explicitly disclaimed therefrom and do not form a part of this invention.

In one embodiment, the bath is substantially free, preferably completely free, of other alloying metals than zinc and nickel ions.

In one embodiment, the at least one triazole derivative is selected from the group consisting of 3-mercapto-1,2,4-triazole; 1,2,4-triazole; 1,2,4-triazole-3-carboxylic acid; 3-amino-1,2,4-triazole; 3-methyl-1H-1,2,4-triazole; 3,5-diamino-1,2,4-triazole; 3-amino-5-mercapto-1,2,4-triazole; 3-(methylsulfonyl)-1H-1,2,4-triazole; 5-phenyl-1H-1,2,4-triazole-3-thiol; 1-phenyl-1H-(1,2,4)-triazole-3-thiol; and methyl-1H-1,2,4-triazole-3-carboxylate.

In one embodiment, the at least one first poly(ethylene glycol) derivative is selected from the group consisting of poly(ethylene glycol) 4-nonylphenyl 3-sulfopropyl ether potassium salt (CAS 119438-10-7); poly(ethylene glycol) alkyl (3-sulfopropyl) diether potassium salt (CAS 119481-71-9); poly(ethylene glycol)methyl ether thiol; poly(ethylene glycol) methyl ether tosylate (CAS 58320-73-3); and poly(ethylene glycol) 2-mercaptoethyl ether acetic acid (CAS 165729-81-7).

In one embodiment, the at least one triazole derivative is 3-mercapto-1,2,4-triazole and the at least one first poly (ethylene glycol) derivative is poly(ethylene glycol)alkyl (3-sulfopropyl)diether potassium salt (CAS 119481-71-9).

In one embodiment, the concentration of the at least one triazole derivative ranges from 0.5 to 7.5 mg/l, preferably from 0.75 to 6.5 mg/l, and more preferably from 1 to 5 mg/l.

In one embodiment, the concentration of the at least one first poly(ethylene glycol) derivative ranges from 0.5 to 7.5 g/l, preferably from 0.75 to 4.5 g/l, and more preferably from 1 to 5 g/l.

In one preferred embodiment, the bath is further comprising (v) at least one second poly(ethylene glycol) derivative having the general formula (III)

$$R_6—[O—CH_2—CH_2]_n—O—R_7 \quad \text{(III)}$$

wherein n is ranging from 2 to 200;

$R_6$ is selected from the group consisting of a linear or branched $C_1$-$C_{18}$ alkyl, —$CH_2$—COOH, glycidyl, and —$CH_2$—$CH_2$—$NH_2$; and $R_7$ is selected from the group consisting of hydrogen, —$CH_2$—COOH, glycidyl, and —O—$CH_3$.

Such a further additive can still improve the wetting behaviour of the substrate to be electroplated without negatively influencing the electroplating itself. It can be exemplarily be helpful for the electroplating of the substrate if said further additive is a foam reducer (facilitated working conditions) or a gloss enhancer (improved optical appearance).

Said at least one second poly(ethylene glycol) derivative having the general formula (III) is in the context of this present invention always different from the essential at least one first poly(ethylene glycol) derivative having the general formula (II).

In said preferred embodiment, the at least one second poly(ethylene glycol) derivative is selected from the group consisting of octa(ethylene glycol)octyl ether (CAS 26468-86-0), poly(ethylene glycol) bis(carboxymethyl)ether (CAS 39927-08-7), poly(ethylene glycol)diglycidyl ether (CAS 72207-80-8), poly(ethylene glycol)dimethyl ether (CAS 24991-55-7), and poly(ethylene glycol)methyl ether amine (CAS 80506-64-5).

In said preferred embodiment, the concentration of the at least one second poly(ethylene glycol) derivative ranges from 0.5 to 7.5 g/l, preferably from 0.75 to 4.5 g/l, and more preferably from 1 to 5 g/l.

In a more preferred embodiment, the at least one triazole derivative is 3-mercapto-1,2,4-triazole, the at least one first poly(ethylene glycol) derivative is poly(ethylene glycol) alkyl (3-sulfopropyl)diether potassium salt (CAS 119481-71-9), and the at least one second poly(ethylene glycol) derivative is octa(ethylene glycol)octyl ether (CAS 26468-86-0).

The acidic electroplating bath according to the present invention optionally further comprises a buffer additive such as acetic acid, a mixture of acetic acid and a corresponding salt, boric acid and the like in order to maintain the desired pH value range during operation of said electroplating bath.

In a preferred embodiment, the bath is substantially free, preferably completely free, of boric acid.

The expression "substantially free" means in the context of the present invention a concentration of less than 0.2 g/l, preferably less than 0.1 g/l, and more preferably less than 0.05 g/l.

In one embodiment, the concentration of zinc ions ranges from 5 to 100 g/l, preferably from 10 to 50 g/l, and more preferably from 15 to 35 g/l.

In one embodiment (in case of a zinc-nickel alloy electroplating bath), the concentration of nickel ions ranges from 5 to 100 g/l, preferably from 10 to 50 g/l, and more preferably from 15 to 35 g/l.

Further, the object of the present invention is also solved by a method for zinc or zinc-nickel alloy electroplating comprising, in this order, the steps of (i) providing a substrate having a metallic surface as a cathode, (ii) contacting said substrate with an acidic zinc or zinc-nickel alloy electroplating bath according to the present invention, (iii) applying an electrical current between said substrate and at least one anode and thereby depositing a zinc or zinc-nickel alloy layer with an improved thickness onto said substrate.

Suitable anode materials are for example zinc, nickel and mixed anodes comprising zinc and nickel. The electroplating bath is preferably held at a temperature in the range of 20 to 50° C.

The acidic zinc and zinc-nickel alloy electroplating bath according the present invention can be employed in all types of industrial zinc and zinc-nickel alloy electroplating processes such as rack electroplating, barrel electroplating and high speed electroplating of metal strips and wires.

The current density ranges applied to the substrate (cathode) and at least one anode depends from the electroplating process. A current density in the range of 0.3 to 5 A/dm$^2$ is preferably applied for rack electroplating and barrel electroplating.

The technical effect of an improved throwing power is most preferably used for electroplating of substrates having a complex shape and/or in rack electroplating and barrel electroplating. Typical substrates having a complex shape comprise brake calipers, holders, clamps and tubes.

The phrase "complex shape" in respect to substrates to be electroplated by the method according to the present invention is defined herein as a shape which generates different local current density values on the surface during electroplating. In contrast, a substrate having e.g. an essentially flat, plate-like shape such as a metal strip is not considered a substrate having a complex shape.

The present invention thus addresses the problem of improving the thickness in the low current density area by an increased electroplating speed in this area while at the same time burnings in the high current density area is avoided.

The following non-limiting examples are provided to illustrate different embodiments of the present invention and to facilitate understanding of the invention, but are not intended to limit the scope of the invention, which is defined by the claims appended hereto.

General Procedure:

The electroplating experiments were conducted in a Hull-cell in order to simulate a wide range of local current densities on the substrate ("Hull-cell panel") during electroplating. The substrate material was steel and the size was 100 mm×75 mm.

The desired technical effect of an improved throwing power was determined by thickness measurements of the deposited zinc and zinc-nickel alloy layers by X-ray fluorescence measurements using a Fischerscope X-Ray XDL-B device from Helmut Fischer GmbH. Thickness readings were made in defined distances from the high local current density (HCD) area end over the entire substrate up to the low local current density (LCD) area end of each respective Hull cell panel (substrate). The thicknesses have been given in micrometers in Tables 1 and 2 at the respective distances of 0.5, 2.5, 5, 7.5, 9.5, and 9.8 cm from the HCD end of each substrate. The substrates have been electroplated with an applied current of 1 Ampère.

The throwing power of the electroplating baths tested was determined from the thickness values measured over the entire Hull cell panels. Additionally, the optical appearance have been scrutinized for burnings in the HCD area, which would have a negatively impact on the overall result.

The inventive effect of the claimed electroplating baths comprising a selective combination of additives was determined by comparing their electroplating results on Hull cell panels with comparative Hull cell panels, which has been electroplated by the same standard acidic zinc or zinc-nickel alloy electroplating bath but without such a selective combination of additives.

The experiments given in Tables 1 and 2 are numbered in consequent order wherein the second number in parentheses is an internal experiment number of the applicant.

All experiments in Tables 1 and 2 have been done with 3-mercapto-1,2,4-triazole (F1 additive), poly(ethylene glycol)alkyl(3-sulfopropyl)diether potassium salt (CAS 119481-71-9; F2 additive), and octa(ethylene glycol)octyl ether (CAS 26468-86-0, F3 additive).

The experiments given in Tables 1 and 2, wherein the experimental number in the first column is followed by a symbol "*" represent comparative examples outside of the present invention.

The numbers in the columns below the disclosed distances 0.5, 2.5, 5, 7.5, 9.5, and 9.8 from the HCD end are the measured thicknesses of the zinc or the zinc-nickel alloy layer on the substrate after having being electroplated.

Table 1 shows conducted experiments (at 1 Ampère) for acidic zinc electroplating baths with and without comprising the selective additive combination of the present invention as claimed.

TABLE 1

| Experiments for acidic zinc electroplating baths | | | | | | | | | |
|---|---|---|---|---|---|---|---|---|---|
| Exp. | F1 | F2 | F3 | Distance from HCD end [cm] | | | | | |
| No. | [mg/l] | [g/l] | [g/l] | 0.5 | 2.5 | 5 | 7.5 | 9.5 | 9.8 |
| 1* (4579) | 0 | 0 | 0 | 11.8 | 6.12 | 3.57 | 2.08 | 1.30 | 1.21 |
| 2* (4580) | 4 | 0 | 0 | 12.5 | 6.41 | 3.79 | 2.39 | 1.56 | 1.42 |
| 3* (4583) | 8 | 0 | 0 | 12 | 6.07 | 3.52 | 2.07 | 1.45 | 1.28 |
| 4* (4584) | 16 | 0 | 0 | 12.6 | 5.93 | 3.55 | 2.17 | 1.47 | 1.40 |
| 5* (4587) | 0 | 0.5 | 0 | 12 | 6.24 | 3.77 | 2.15 | 1.47 | 1.30 |
| 6* (4588) | 0 | 1 | 0 | 12.9 | 6.41 | 3.82 | 2.23 | 1.60 | 1.40 |
| 7* (4589) | 0 | 2 | 0 | 11.6 | 6.75 | 4.06 | 2.48 | 1.70 | 1.45 |
| 8 (4593) | 4 | 1 | 0 | 12.7 | 6.49 | 3.97 | 2.45 | 1.67 | 1.58 |
| 9 (4594) | 4 | 2 | 0 | 11.3 | 6.64 | 4.20 | 2.53 | 1.88 | 1.70 |
| 10 (4595) | 4 | 4 | 0 | 12.2 | 5.80 | 4.01 | 2.71 | 2.03 | 1.83 |
| 11* (4596) | 4 | 8 | 0 | 8.48 | 6.53 | 4.05 | 2.82 | 1.83 | 1.42 |
| 12* (4597) | 8 | 1 | 0 | 12.5 | 6.47 | 3.74 | 2.23 | 1.52 | 1.35 |
| 13 (4605) | 4 | 1 | 1 | 13.1 | 6.69 | 3.98 | 2.43 | 1.87 | 1.73 |
| 14 (4606) | 4 | 2 | 2 | 11.9 | 6.84 | 4.05 | 2.60 | 2.03 | 1.91 |

The results given in Table 1 prove that a selective combination of additives F1 and F2 (inventive experiments 8 to 10) shows superior layer thicknesses in the LCD area at a distance of 9.8 and 9.5 from the HCD end of the Hull cell panel compared to experiments having none of the three additives comprised (comparative experiment 1). The same applies in comparison to experiments comprising only Fl (comparative experiments 2 to 4) or F2 (comparative experiments 5 to 7). Comparative experiment 11 has a too high concentration of F2 while comparative experiment 12 has a too high concentration of F1. Thus, experiments 11 and 12 can thereby prove the selectivity of this invention, wherein it is not even sufficient to find out the right combination of additives, but also their specific suitable concentrations, respectively. Inventive Experiments 13 and 14 finally show that a combination of F1, F2 and F3 is providing even still better results in layer thickness in the LCD areas.

Table 2 shows conducted experiments (at 1 Ampère) for acidic zinc-nickel alloy electroplating baths with and without comprising the selective additive combination of the present invention as claimed.

TABLE 2

| Experiments for acidic zinc-nickel alloy electroplating baths | | | | | | | | | |
|---|---|---|---|---|---|---|---|---|---|
| Exp. | F1 | F2 | F3 | Distance from HCD end [cm] | | | | | |
| No. | [mg/l] | [g/l] | [g/l] | 0.5 | 2.5 | 5 | 7.5 | 9.5 | 9.8 |
| 15* (4598) | 0 | 0 | 0 | 15.8 | 7.52 | 5.53 | 2.78 | 2.33 | 1.28 |
| 16* (4611) | 0 | 1 | 0 | 18.8 | 8.90 | 6.22 | 3.09 | 3.59 | 2.92 |
| 17* (4612) | 0 | 4 | 0 | 19.4 | 9.95 | 7.23 | 4.51 | 2.75 | 2.10 |
| 18* (4615) | 16 | 0 | 0 | 18.9 | 8.49 | 5.93 | 3.11 | 1.81 | 1.56 |
| 19 (4609) | 4 | 2 | 0 | 20 | 10.6 | 5.85 | 4.29 | 3.90 | 3.53 |
| 20 (4616) | 4 | 1 | 0 | 17.7 | 10.3 | 5.71 | 3.86 | 3.81 | 3.22 |
| 21* (4617) | 8 | 1 | 0 | 20.2 | 9.86 | 5.30 | 4.01 | 3.33 | 2.90 |
| 22 (4618) | 4 | 1 | 1 | 15.5 | 10.6 | 5.96 | 3.92 | 3.89 | 3.43 |
| 23 (4610) | 4 | 2 | 2 | 18.2 | 12.4 | 6.62 | 4.71 | 4.02 | 3.68 |

The technical effect of the selective combination of additives F1 with F2, and preferably of F1, F2 and F3 has been successfully shown as well for a zinc-nickel alloy electroplating bath.

All inventive experiments given in Tables 1 and 2 have been showing no significant burnings in the HCD areas close to the HCD end of the Hull Cell panel (distance of 0.5 and 2.5 cm).

While the principles of the invention have been explained in relation to certain particular embodiments, and are provided for purposes of illustration, it is to be understood that various modifications thereof will become apparent to those skilled in the art upon reading the specification. Therefore, it is to be understood that the invention disclosed herein is intended to cover such modifications as fall within the scope of the appended claims. The scope of the invention is limited only by the scope of the appended claims.

The invention claimed is:

1. An acidic zinc or zinc-nickel alloy electroplating bath for depositing a zinc or zinc-nickel alloy layer characterized in that the electroplating bath comprises:

(i) at least a zinc ion source;

(ii) at least one triazole derivative having the general formula (I):

(I)

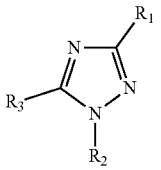

wherein $R_1$ is selected from the group consisting of hydrogen, thiol, carboxylic acid, amino, methyl, methylsulfonyl, and methyl carboxylate;

$R_2$ is hydrogen or phenyl; and $R_3$ is selected from the group consisting of hydrogen, amino, thiol, and phenyl, and wherein concentration of the at least one triazole derivative ranges from 0.5 to 7.5 mg/l;

(iii) at least one first poly(ethylene glycol) derivative having the general formula (II):

$$R_4—[O—CH_2—CH_2]_n—O—R_5 \quad (II)$$

wherein n is ranging from 2 to 200;

$R_4$ is selected from the group consisting of a linear or branched $C_1$-$C_{18}$ alkyl, 4-nonylphenyl, and a linear or branched $C_1$-$C_{18}$ alkyl having a carboxylic group;

$R_5$ is selected from the group consisting of $—CH_2—CH_2—CH_2—SO_3Z$, $—CH_2—CH_2—SH$, and tosyl;

wherein Z is a monovalent cation, and wherein concentration of the at least one first poly(ethylene glycol) derivative ranges from 0.5 to 7.5 g/l; and (iv) in case of a zinc-nickel alloy electroplating bath at least a nickel ion source.

2. The acidic zinc or zinc-nickel alloy electroplating bath according to claim 1 characterized in that the bath is substantially free, preferably completely free, of other alloying metals than zinc and nickel ions.

3. The acidic zinc or zinc-nickel alloy electroplating bath according to claim 1 characterized in that the at least one triazole derivative is selected from the group consisting of 3-mercapto-1,2,4-triazole;

1,2,4-triazole; 1,2,4-triazole-3-carboxylic acid; 3-amino-1,2,4-triazole; 3-methyl-1H-1,2,4-triazole; 3,5-diamino-1,2,4-triazole; 3-amino-5-mercapto-1,2,4-triazole; 3-(methylsulfonyl)-1H-1,2,4-triazole; 5-phenyl-1H-1,2,4-triazole-3-thiol; 1-phenyl-1H-(1,2,4)-triazole-3-thiol; and methyl-1H-1,2,4-triazole-3-carboxylate.

4. The acidic zinc or zinc-nickel alloy electroplating bath according to claim 1 characterized in that the at least one first poly(ethylene glycol) derivative is selected from the group consisting of poly(ethylene glycol) 4-nonylphenyl 3-sulfopropyl ether potassium salt (CAS 119438-10-7); poly (ethylene glycol)alkyl(3-sulfopropyl)diether potassium salt (CAS 119481-71-9); poly(ethylene glycol)methyl ether thiol; poly(ethylene glycol)methyl ether tosylate (CAS 58320-73-3); and poly(ethylene glycol) 2-mercaptoethyl ether acetic acid (CAS 165729-81-7).

5. The acidic zinc or zinc-nickel alloy electroplating bath according to claim 1 characterized in that the at least one triazole derivative is 3-mercapto-1,2,4-triazole and that the at least one first poly(ethylene glycol) derivative is poly (ethylene glycol)alkyl(3-sulfopropyl)diether potassium salt (CAS 119481-71-9).

6. The acidic zinc or zinc-nickel alloy electroplating bath according to claim 1 characterized in that the bath is further comprising (v) at least one second poly(ethylene glycol) derivative having the general formula (III):

$$R_6—[O—CH_2—CH_2]_n—O—R_7 \quad (III)$$

wherein n is ranging from 2 to 200;

$R_6$ is selected from the group consisting of a linear or branched $C_1$-$C_{18}$ alkyl, $—CH_2—COOH$, glycidyl, and $—CH_2—CH_2—NH_2$; and $R_7$ is selected from the group consisting of hydrogen, $—CH_2—COOH$, glycidyl, and $—O—CH_3$.

7. The acidic zinc or zinc-nickel alloy electroplating bath according to claim 6 characterized in that the at least one second poly(ethylene glycol) derivative is selected from the group consisting of octa(ethylene glycol) octyl ether (CAS 26468-86-0), poly(ethylene glycol) bis(carboxymethyl) ether (CAS 39927-08-7), poly(ethylene glycol) diglycidyl ether (CAS 72207-80-8), poly(ethylene glycol) dimethyl ether (CAS 24991-55-7), and poly(ethylene glycol) methyl ether amine (CAS 80506-64-5).

8. The acidic zinc or zinc-nickel alloy electroplating bath according to claim 6 characterized in that the concentration of the at least one second poly(ethylene glycol) derivative ranges from 0.5 to 7.5 g/l, preferably from 0.75 to 4.5 g/l, and more preferably from 1 to 5 g/l.

9. An acidic zinc or zinc-nickel alloy electroplating bath according to claim 6 characterized in that the at least one triazole derivative is 3-mercapto-1,2,4-triazole, the at least one first poly(ethylene glycol) derivative is poly(ethylene glycol)alkyl (3-sulfopropyl)diether potassium salt (CAS 119481-71-9), and the at least one second poly(ethylene glycol) derivative is octa(ethylene glycol)octyl ether (CAS 26468-86-0).

10. The acidic zinc or zinc-nickel alloy electroplating bath according to claim 6 characterized in that the bath is substantially free of boric acid.

11. The acidic zinc or zinc-nickel alloy electroplating bath according to claim 6 characterized in that the concentration of zinc ions ranges from 5 to 100 g/l.

12. The acidic zinc or zinc-nickel alloy electroplating bath according to claim 6 characterized in that in case of a zinc-nickel alloy electroplating bath the concentration of nickel ions ranges from 5 to 100 g/l.

13. The acidic zinc or zinc-nickel alloy electroplating bath according to claim 1 characterized in that the bath is substantially free, preferably completely free, of boric acid.

14. The acidic zinc or zinc-nickel alloy electroplating bath according to claim 1 characterized in that the concentration of zinc ions ranges from 5 to 100 g/l.

15. The acidic zinc or zinc-nickel alloy electroplating bath according to claim 1 characterized in that in case of a zinc-nickel alloy electroplating bath the concentration of nickel ions ranges from 5 to 100 g/l.

16. The acidic zinc or zinc-nickel alloy electroplating bath according to claim 1 characterized in that the at least one first poly(ethylene glycol) derivative is poly(ethylene glycol) 4-nonylphenyl 3-sulfopropyl ether potassium salt (CAS 119438-10-7).

17. A method for zinc or zinc-nickel alloy electroplating comprising, in this order, the steps of (i) providing a substrate having a metallic surface as a cathode, (ii) contacting said substrate with an acidic zinc or zinc-nickel alloy electroplating bath according to claim 1, and (iii) applying an electrical current between said substrate and at least one anode and thereby depositing a zinc or zinc-nickel alloy layer with an improved thickness onto said substrate.

18. A method for zinc or zinc-nickel alloy electroplating comprising, in this order, the steps of (i) providing a substrate having a metallic surface as a cathode, (ii) contacting said substrate with an acidic zinc or zinc-nickel alloy electroplating bath according to claim 6, and (iii) applying an electrical current between said substrate and at least one anode and thereby depositing a zinc or zinc-nickel alloy layer with an improved thickness onto said substrate.

19. A method for zinc or zinc-nickel alloy electroplating comprising, in this order, the steps of:

(i)providing a substrate having a metallic surface as a cathode, (ii) contacting said substrate with an acidic zinc or zinc-nickel alloy electroplating bath comprising:

at least a zinc ion source;

at least one triazole derivative having the general formula (I):

(I)

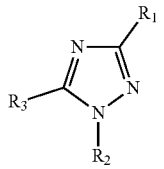

wherein $R_1$ is selected from the group consisting of hydrogen, thiol, carboxylic acid, amino, methyl, methylsulfonyl, and methyl carboxylate;

$R_2$ is hydrogen or phenyl; and $R_3$ is selected from the group consisting of hydrogen, amino, thiol, and phenyl, and wherein concentration of the at least one triazole derivative having the general formula (I) is in a range of 0.5 to 7.5 mg/l;

at least one first poly(ethylene glycol) derivative having the general formula (II):

R4-[O-CH2-CH2]n-O-R5 (II)

wherein n is ranging from 2 to 200;

R4 is selected from the group consisting of a linear or branched $C_1$-$C_{18}$ alkyl, 4-nonylphenyl, and a linear or branched $C_1$-$C_{18}$ alkyl having a carboxylic group;

R5 is selected from the group consisting of —$CH_2$—$CH_2$—$CH_2$—$SO_3Z$, —$CH_2$—$CH_2$—SH, and tosyl;

wherein Z is a monovalent cation; and in case of a zinc-nickel alloy electroplating bath at least a nickel ion source, and (iii) applying an electrical current between said substrate and at least one anode and thereby depositing a zinc or zinc-nickel alloy layer with an improved thickness onto said substrate, wherein the electroplating bath is held at a temperature in the range of 20 to 50° C.

20. The method of claim 19, wherein the electrical current has a current density in the range of 0.3 to 5 A/dm$^2$.

21. The method of claim 19 applied for rack electroplating or for barrel electroplating.

* * * * *